US006398454B1

(12) United States Patent
Bitelli

(10) Patent No.: US 6,398,454 B1
(45) Date of Patent: Jun. 4, 2002

(54) VIBRATORY FINISHING MACHINE FOR ROAD ASPHALTING

(76) Inventor: Romolo Bitelli, Via IV Novembre, 2 - 40061, Minerbio (BO) (IT)

( * ) Notice: Subject to any disclaimer, the term of this patent is extended or adjusted under 35 U.S.C. 154(b) by 0 days.

(21) Appl. No.: 09/490,108

(22) Filed: Jan. 24, 2000

(51) Int. Cl.[7] ..... E01C 19/22
(52) U.S. Cl. ..... 404/118
(58) Field of Search ..... 404/84.1, 84.5, 404/101, 105, 106, 108, 118; 73/290 R, 427, 866.3

(56) References Cited

U.S. PATENT DOCUMENTS

| | | | | | |
|---|---|---|---|---|---|
| 662,273 | A | * | 11/1900 | Hinkelbein | 73/290 R |
| 845,530 | A | * | 2/1907 | Davis | 73/290 R |
| 1,029,894 | A | * | 6/1912 | Schellenger | 404/83 |
| 1,566,015 | A | * | 12/1925 | Johnson | 73/260 R |
| 3,175,477 | A | * | 3/1965 | Cheney | 404/84.05 |
| 3,557,672 | A | * | 1/1971 | Shurtz et al. | 404/95 |
| 3,638,540 | A | | 2/1972 | Williams | |
| 4,267,777 | A | * | 5/1981 | Theurer et al. | 107/7 R |
| 4,780,022 | A | * | 10/1988 | Ohiba et al. | 404/90 |
| 4,801,218 | A | * | 1/1989 | Musil | 404/84 |
| 4,823,366 | A | * | 4/1989 | Williams | 377/2 |
| 5,044,820 | A | * | 9/1991 | Prang | 404/84.05 |
| 5,190,398 | A | * | 3/1993 | Swisher, Jr. | 404/90 |
| 5,344,254 | A | | 9/1994 | Sartain | |
| 5,393,167 | A | * | 2/1995 | Fujita et al. | 404/84.1 |
| 5,452,966 | A | * | 9/1995 | Swisher, Jr. | 404/72 |
| 5,588,776 | A | * | 12/1996 | Swisher, Jr. et al. | 404/72 |
| 5,705,747 | A | * | 1/1998 | Bailey | 73/290 R |
| 6,027,282 | A | * | 2/2000 | Horn | 404/75 |

FOREIGN PATENT DOCUMENTS

| | | |
|---|---|---|
| EP | 0 495 171 a1 | 11/1991 |

* cited by examiner

*Primary Examiner*—Gary S. Hartmann
(74) *Attorney, Agent, or Firm*—Dykema Gossett PLLC

(57) ABSTRACT

A self-propelled vibratory finishing machine for asphalting road surfaces having a frame and a frame supporting storage for storing and distributing bitumen aggregate. The finishing machine also has a press for pressing the bitumen aggregate and flat elements for scraping along the surface being asphalted. The flat elements are set on the sides of the machine and are connected to the press and are vertically mobile with respect to the press. The finishing machine also has a detector for detecting the thickness of bitumen aggregate deposited.

9 Claims, 3 Drawing Sheets

VIBRATORY FINISHING MACHINE FOR ROAD ASPHALTING

BACKGROUND OF THE INVENTION

This invention relates to a vibratory finishing machine used for asphalting roads especially suited for maintaining a constant thickness of the layer of asphalt deposited and compacted by the machine itself.

DESCRIPTION OF THE RELATED ART

It is known that asphalting work on roads often uses self-propelled machines, called vibratory compactors, which fundamentally consist of a frame, shaped to provide a driver's cab and housing the machine's traction means.

The frame also supports a mobile, walled bin containing the hot bitumen aggregate that, retrieved by a conveyor belt, is deposited on the surface being asphalted by the action of a pair of worm screws standing side by side, set crossways to the machine's direction of travel and made to rotate by a mechanical transmission unit.

While the bitumen aggregate is still hot, it is uniformly distributed over the road coarse and then compacted by means of a device, called a "vibratory compactor", set behind the worm screws with respect to the machine's direction of travel.

The vibratory compactor is connected to the end of a heavy-duty mechanical arm pivoted on the machine frame and hydraulic jacks on its other end suited to raising and lowering the vibratory compactor according to work needs.

More precisely the vibratory compactor comprises a plowshare element basically consisting of a heavy-duty plate bent to form an L-shape set crossways to the machine's direction of travel, with the longer wing nearly perpendicular to the road coarse and the shorter wing parallel to the actual coarse.

The plowshare spreads the bitumen aggregate distributed by the worm screws preparing it for compacting by a vertically oscillating beam, which is also set crossways to the machine's direction of travel and made to vibrate by a device connected to it.

Normally vibratory finishing machines have, next to the two sides of the vibratory compactor device, vertically sliding flat elements that slide and/or scrape along the floor being asphalted and are used to retain the material deposited within the work area of the vibratory compactor.

As is known, the thickness of the asphalt layer depends on the machine's travel speed and on the thickness of asphalt deposited that is controlled by adjusting the hydraulic jacks that raise/lower a rear heavy-duty arm that supports the plowshare-vibratory elements.

However it may arise for various reasons that the thickness of asphalt layer deposited and compacted undergoes variations during the travel of the vibratory finishing machine, causing unwanted waviness in the runway of the finished road coarse.

To overcome this inconvenience, known technology has fitted the machine with special electronic type, automatic level indicators that, detecting these variations, controls the hydraulic jacks to restore the thickness to the set reference level.

These automatic level indicators are however both complex and costly, and what's more they are also delicate, considering the harsh work conditions and the consequent risks of wear and tear they undergo during the asphalting process.

The present device will remedy the aforesaid inconveniences.

BRIEF SUMMARY OF THE INVENTION

An object of the present invention is to produce a vibratory finishing machine that will detect the tendency to variation in thickness of the asphalt coarse deposited, with enough time to correct it.

An additional object is to detect the tendency to have various thicknesses and to ensure prompt corrective actions are made with means that have the benefits of being simple, inexpensive and resistant to the risks of wear and tear.

The objectives are achieved by a self-propelled vibratory finishing machine for asphalting road surfaces comprising a frame housing its traction means, being shaped to provide a driver's cab, and supporting:

- storage means for storage and distribution of the bitumen aggregate to be deposited on the aforementioned surfaces;
- pressing means for the bitumen aggregate to be deposited, the pressing means is set crossways to the direction of travel of the machine;
- flat elements having a primarily longitudinal construction scraping along the surface being asphalted, the flat elements are set on the sides of the machine, they are connected to the pressing means and they are vertically mobile with respect to the pressing means;
- such a machine has a means of detection for the thickness of bitumen aggregate deposited, the detection means has first means of reference connected to the flat elements which work together with second means of reference connected to the pressing means. The thickness being measured by the relative deviation between the first and the second means.

According to a preferred form of execution, each means of detection comprises a pointer and a calibrated rule.

According to a variant in execution, the means of detection is connected to an automatic signalling device, being either visual and/or acoustic, of the variation in level.

BRIEF DESCRIPTION OF THE DRAWINGS

The objectives described above shall be better explained during the description of a preferred form of execution of the finding, given as a guideline but not a limitation and illustrated in the attached diagrams.

DETAILED DESCRIPTION OF THE INVENTION

Figure 1:
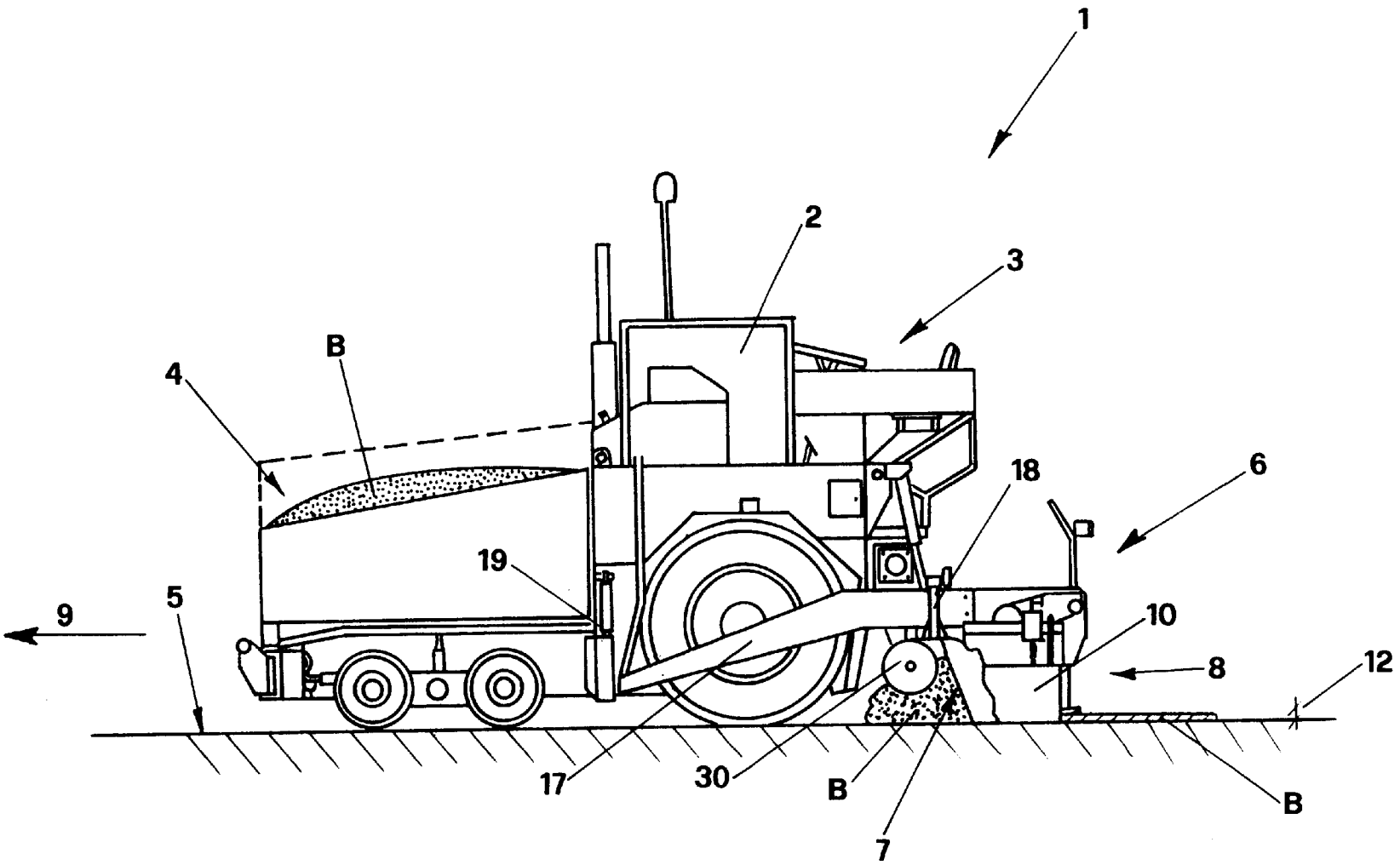
FIG. 1 is a side elevation view of the vibratory finishing machine of the present invention.

The self-propelled vibratory finishing machine for asphalting road surfaces, is illustrated in FIG. 1, where it is generally indicated by number 1 and comprises a frame 2 housing traction means and being shaped to provide a driver's cab 3. The frame 2 also supports the storage means of bitumen aggregate B to be deposited, consisting of a mobile, walled bin 4.

The aggregate B, by a suitable means of distribution, preferably consisting of a conveyor belt not Illustrated, is deposited over the road surface 5 being asphalted.

Pressing means, generally indicated by 6, consisting of a plowshare 7 and a vibrating beam 8 are set crossways to the direction of travel 9 of the machine 1 and allow the bitumen aggregate B previously deposited to be compacted.

A pair of flat elements 10 having a primarily longitudinal construction scraping along the surface 5 being asphalted are each connected by the pressing means 6, in relation to which they are vertically mobile, to one side of the machine 1.

Figure 2:
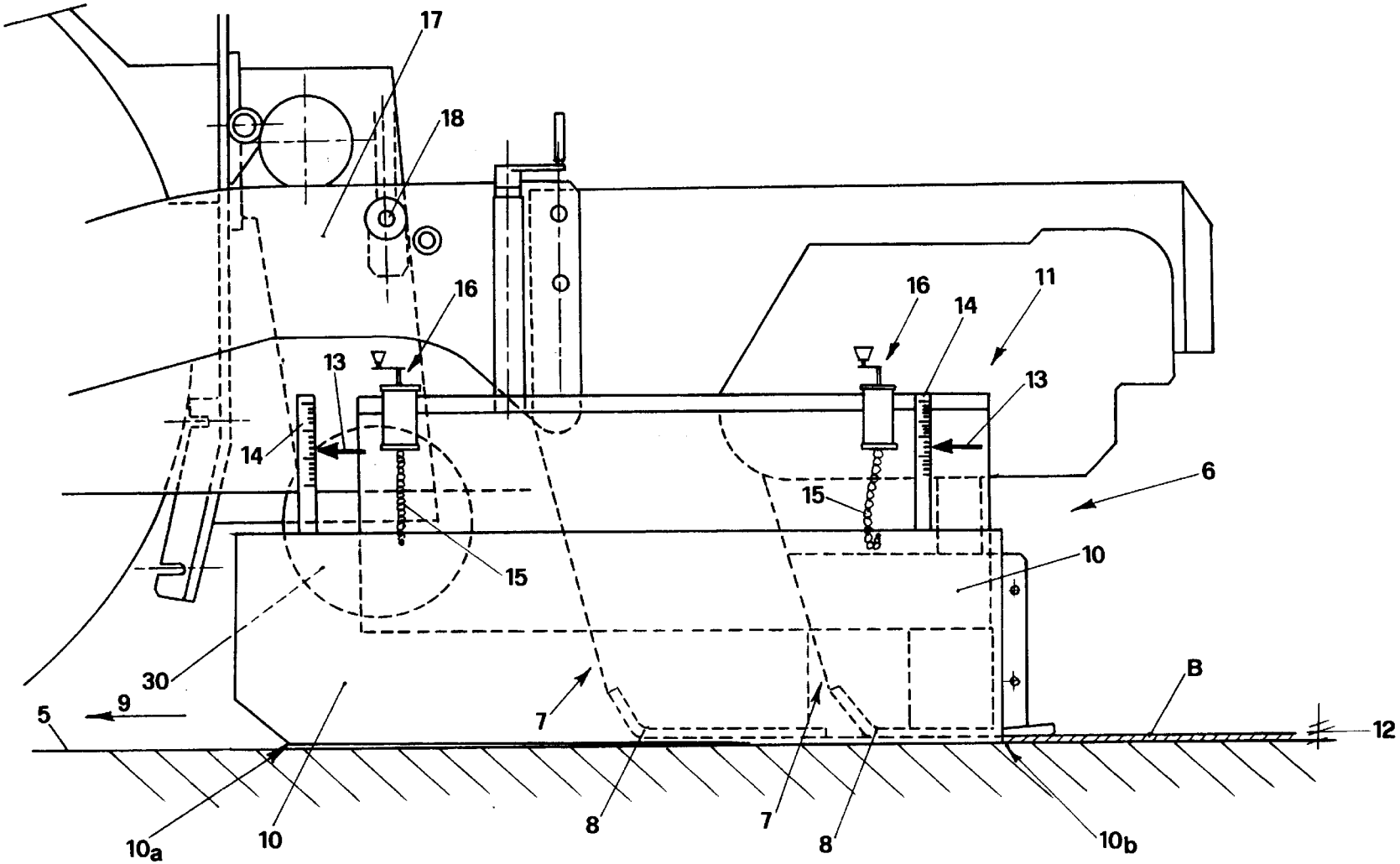
FIG. 2 is a partial side elevation view showing a detail of the detection means.

The finding prescribes that the vibratory finishing machine i comprises means of detection 11, as can be seen in detail in FIG. 2 of the thickness 12 of bitumen aggregate B deposited, which comprise first means of reference 13 connected to the flat elements 10 working together with second means of reference preferably consisting of a calibrated rule 14, connected to the pressing means 6.

In particular the flat elements 10 are connected to one end of chains 15 having their opposite ends connected to handwheels 16 that allow them to be shortened and lengthened.

With regards to the calibrated rule 14, it is mounted on the top edge of the flat element 10 and works together with the first reference means 13 such as a pointer which is connected to the pressing means 6.

Figure 3:
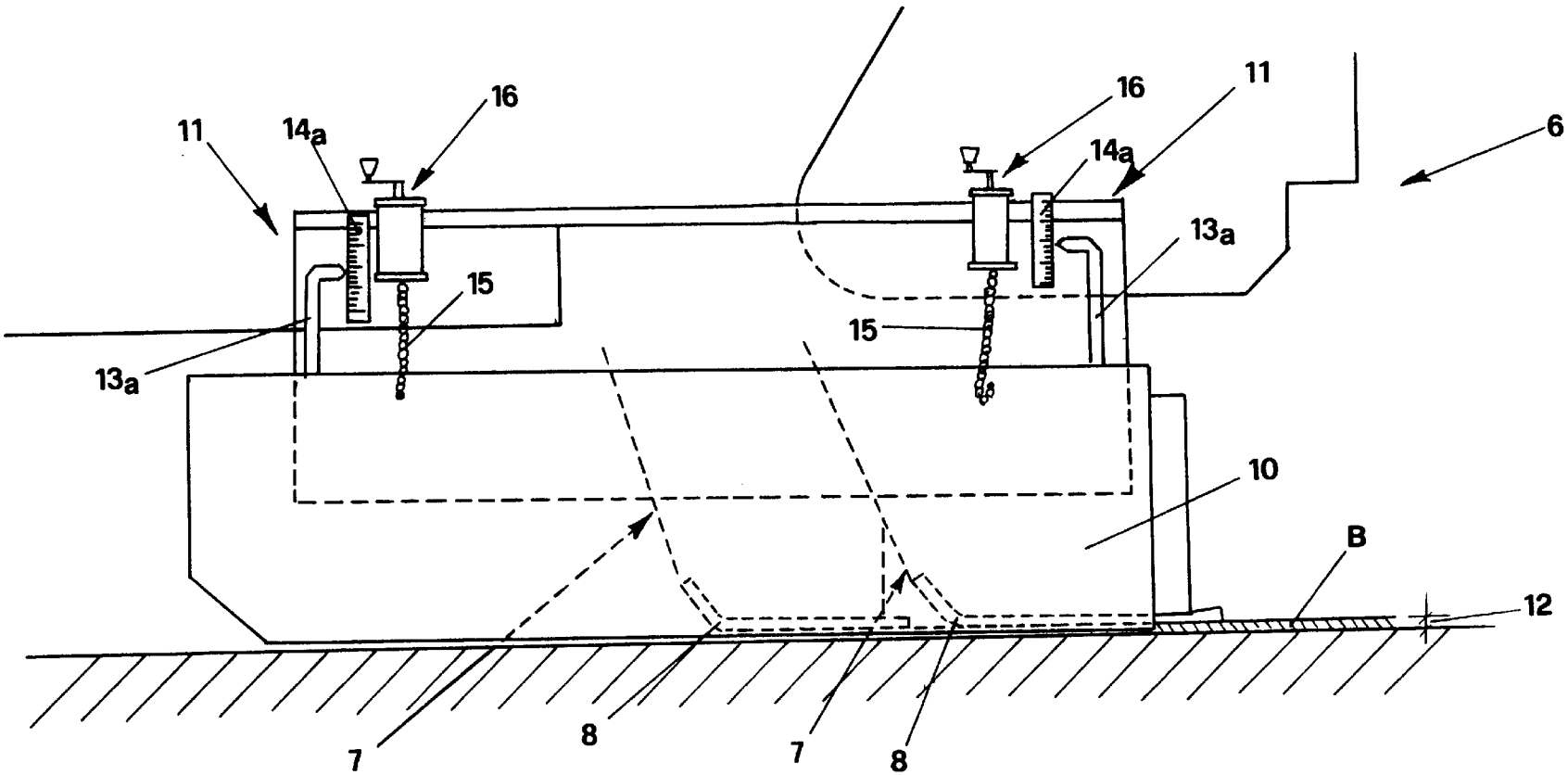
FIG. 3 is a partial side elevation view of the machine showing a detail of the pressing means.

According to a variant in execution illustrated in FIG. 3, the pointer 13*a* is connected to the flat element 10 while the calibrated rule 14*a* is mechanically connected to the pressing means 6.

The relative deviation between the first means of reference 13 and second means of reference 14 allow detection of variations in thickness 12 from a pre-set level of bitumen aggregate B deposited.

With regards to the compacting elements 6, these are mounted at the ends of a pair of mechanical arms 17 pivoted on journals 18 located behind the frame 2. Each mechanical arm 17 also has a hydraulic jack 19 at the opposite end, as illustrated in detail in FIG. 1, suited to allow the actual pressing means 6 to be raised and lowered, thereby enabling adjustments in thickness 12 of the bitumen aggregate B deposited and compacted.

It is also possible to connect proximity devices to the level signalling device or detection means 11 described above which, by an on/off type visual and/or acoustic signal, alert the operator of the tendency to vary the thickness from a set reference level. These devices are readily known and for this reason their detailed description has not been included herein.

In practice, the bitumen aggregate B, fed from the bin 4, is deposited over the road coarse 5 and uniformly distributed on the surface being asphalted by means of a pair of worm screws 30 that can be seen in FIG. 1.

The plowshare 7 and vibratory 8 sections then spread and compact the layer of material B previously distributed on the ground.

The operator can adjust the handwheels 16 to set each flat element 10 so that the front section 10*a* is slightly raised from the road surface 5 and the back section 10*b* scrapes along the actual road surface 5.

Variations in thickness of the compacted bitumen aggregate cause the pressing means 6 to rise/lower which draw the pointer 13 with them therein signalling the variation in thickness on the calibrated rule 14.

The operator, who continually follows the machine can thereby view the pointers 13, or be alerted by the acoustic signals. He can therefore promptly adjust the machine's controls to restore the thickness 12 to its required level. It is clear that during the production of the finding changes may be made to some parts in the execution of the actual finding. Such changes shall nevertheless be protected by this patent.

What is claimed is:

1. A self-propelled vibratory machine for asphalting road surfaces comprising:

a frame, said frame houses traction means and is shaped to provide a driver's cab, said frame supports;

storage means which stores and distributes bitumen aggregate to be deposited on said road surfaces;

pressing means for pressing the bitumen aggregate deposited, said pressing means set crossways to the direction of travel of said machine;

flat elements that scrape along the surface being asphalted, said flat elements are set on the sides of said machine, said flat elements are connected to said pressing means and said flat elements are vertically mobile with respect to said pressing means; and means of detection, for detecting the thickness of bitumen aggregate deposited, said detection means is mechanical and has first reference means and second reference means, said first reference means are connected to said flat elements and said first reference means mechanically operates in conjunction with said second reference means, said second reference means are connected to said pressing means;

wherein said thickness of said bitumen is measured by the relative deviation between said first reference means and said second reference means.

2. A vibratory finishing machine according to claim 1, wherein said first reference means is a pointer and said second reference means is a calibrated rule.

3. A vibratory finishing machine according to claim 1, wherein said first reference means is a calibrated rule and said second reference means is a pointer.

4. A vibratory finishing machine according to claim 1, wherein said means of detection work together with visual signaling devices for signaling the variation in thickness of the bitumen aggregate layer deposited, said visual devices being activated when the relative deviation of said reference means exceeds a pre-set limit.

5. A vibratory finishing machine according to claim 4, wherein said visual signaling devices have light sources generating on/off type signals.

6. A vibratory finishing machine according to claim 1, wherein said means of detection work together with at least one acoustic device for signaling the thickness of the bitumen aggregate layer deposited, said acoustic device being activated when the relative deviation of said reference means exceeds a pre-set limit.

7. A vibratory finishing machine according to claim 6, wherein said acoustic device is a beeper.

8. A vibratory finishing machine according to claim 1, wherein said flat elements are connected to said pressing means by a chain that is connected at one end to a handwheel.

9. A self-propelled vibratory machine for distributing bitumen aggregate on road surfaces, comprising:

a frame, said frame houses traction means and is shaped to provide a driver's cab, said frame supports:

storage means which stores and distributes bitumen aggregate to be deposited on said road surfaces;

pressing means for pressing the bitumen aggregate deposited, said pressing means set crossways to the direction of travel of said machine;

flat elements that scrape along the surface being asphalted, said flat elements are set on the sides of said machine, said flat elements are connected to said pressing means and said flat elements are vertically mobile with respect to said pressing means; and mechanical detection means, for detecting the thickness of bitumen aggregate deposited, said detection means has first reference means that is mechanical, and second reference means that is mechanical, said first reference means are connected to said flat elements and said first reference means and mechanically operates in conjunction with said second reference means, said second reference means are connected to said pressing means;

at least one of said reference means displays units of measurement and a portion of said other reference means is located adjacent said units of measurement so as to indicate one of said units of measurement;

wherein said thickness of said bitumen aggregate is determined by comparing a pre-set level of bitumen aggregate with the indicated unit of measurement.

* * * * *